US005364224A

United States Patent [19]

Padgett

[11] Patent Number: 5,364,224

[45] Date of Patent: Nov. 15, 1994

[54] PORTABLE TILTABLE HOPPER ASSEMBLY

[76] Inventor: James R. Padgett, 2650 French Creek Rd., New Albany, Ind. 47150

[21] Appl. No.: 187,806

[22] Filed: Jan. 27, 1994

Related U.S. Application Data

[63] Continuation of Ser. No. 961,668, Oct. 16, 1992, abandoned.

[51] Int. Cl.[5] ..... B66F 9/12

[52] U.S. Cl. ..... 414/703; 414/419; 414/607; 414/642

[58] Field of Search ..... 414/419–420, 414/425, 471, 483, 487, 540, 548, 607, 641–642, 645, 697, 703, 743, 920

[56] References Cited

U.S. PATENT DOCUMENTS

| | | | |
|---|---|---|---|
| 2,624,481 | 1/1953 | Richey | 414/703 |
| 2,658,634 | 11/1953 | Waller | 414/703 |
| 3,878,959 | 4/1975 | Holdeman et al. | 414/703 |
| 4,042,141 | 8/1977 | Schweigert | 414/703 |
| 4,084,853 | 4/1978 | Keenan | 414/703 X |
| 4,627,782 | 12/1986 | Larson | 414/491 |
| 4,897,013 | 1/1990 | Thompson et al. | 414/703 |
| 4,915,575 | 4/1990 | Langenfeld et al. | 414/703 |
| 5,064,338 | 11/1991 | Lawrence | 414/703 X |
| 5,114,296 | 5/1992 | Badder | 414/607 |

FOREIGN PATENT DOCUMENTS

| | | | |
|---|---|---|---|
| 1330859 | 3/1963 | France | 414/425 |
| 3016037 | 5/1981 | Germany | 414/703 |
| 3400357 | 7/1985 | Germany | 414/920 |
| 0136340 | 10/1980 | Japan | 414/703 |
| 0071271 | 4/1983 | Japan | 414/703 |
| 0534418 | 2/1977 | U.S.S.R. | 414/642 |

*Primary Examiner*—Michael S. Huppert
*Assistant Examiner*—James W. Keenan
*Attorney, Agent, or Firm*—Maurice L. Miller, Jr.

[57] ABSTRACT

A material storage hopper tiltably supported on the bed of a hopper support frame is disclosed, which frame is liftable either by a fork lift or a three point hitch such as used on farm and garden tractors. The frame is ground mountable such that the hopper can be used to store and dump materials while in a stationary, stand alone condition, separate and apart from the three point hitch of a tractor. The frame includes a bracket containing elongated slots in which a pin at the end of the third or central arm of a three point hitch is slidably inserted to permit the frame to level itself when elevated by the hitch above its ground mounted position. The slotted bracket also permits the frame to be self leveling when returned from an elevated to a ground mounted position.

13 Claims, 4 Drawing Sheets

FIG. 1
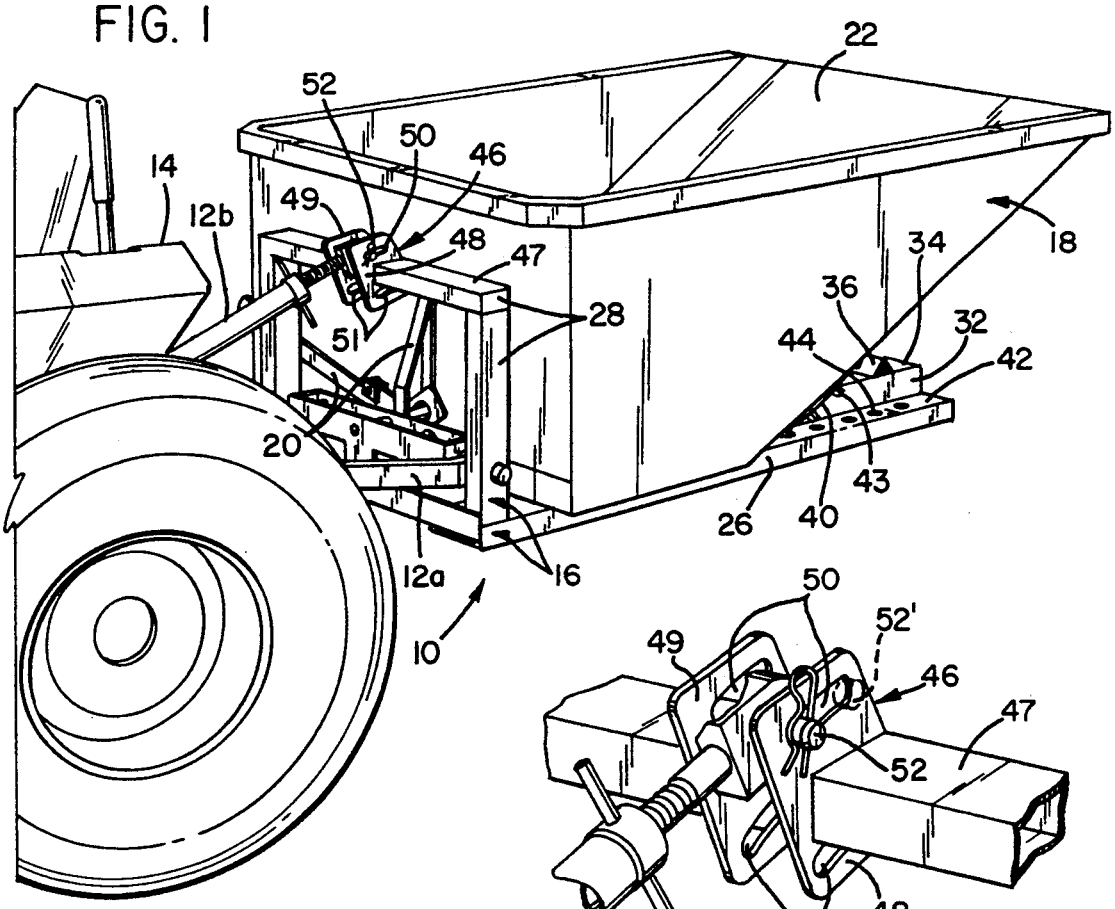
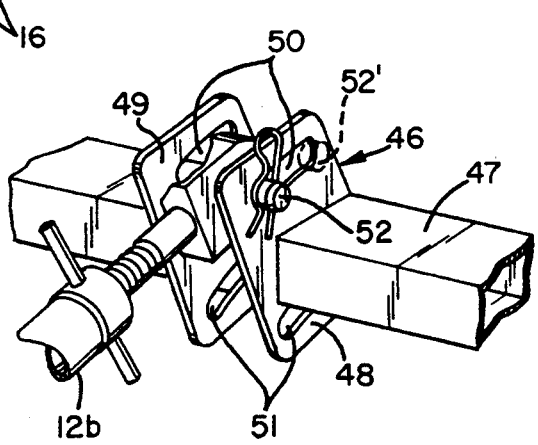
FIG. 2
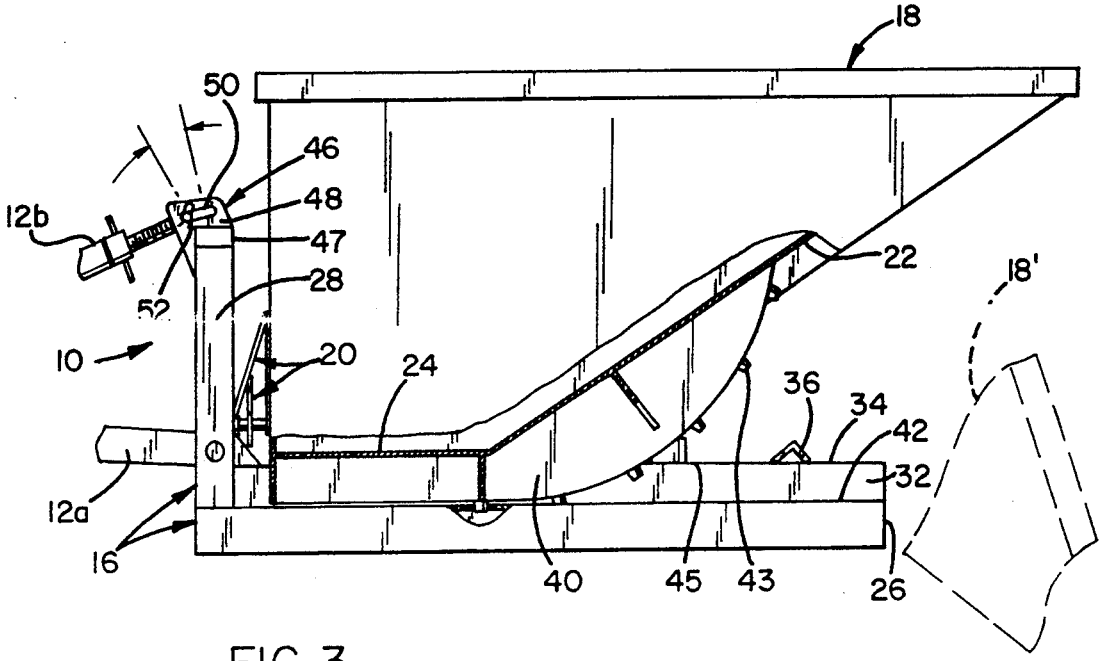
FIG. 3

PORTABLE TILTABLE HOPPER ASSEMBLY

This is a continuation of co-pending U.S. patent application Ser. No. 07/961,668, filed on Oct. 16, 1992, now abandoned.

BACKGROUND OF THE INVENTION

This invention relates generally to tiltable material storing and dumping hopper assemblies which have both stand-alone or stationary ground mounting capability and the capability of being lifted and transported by means of either a fork lift truck or a farm or garden tractor which employs a standard vertically movable three-point hitch mechanism, Additionally, this invention relates to means for the self leveling of a hopper support: frame used in such assemblies when being lifted from and lowered to a ground mounted position by such a three-point hitch mechanism.

Generally speaking, material handling attachments, such as tiltable buckets and hoppers, which can be lifted and transported by means of a three-point hitch mechanism contained on a farm or garden tractor, have long been known and used in the prior art. See for example, the loader bucket assemblies operated by tractor three point hitch mechanisms as disclosed in U.S. Pat. No. 4,897,013 issued to R. H. Thompson et al. on Jan. 30, 1990); U.S. Pat. No. 4,915,013 issued to J. W. Langenfeld et al. on Apr. 10, 1990; and U.S. Pat. No. 2,624,481 issued to C. B. Richey on Jan. 6, 1953. also the frame supported bucket of Japanese pat. no. 58-71271 and tiltable hopper of West German pat. no. DE 3016-037, both of which are operated by a vertically movable tractor hitch.

The bucket assemblies disclosed in the previously identified U.S. patents are primarily adapted for digging and shoveling dirt and other bulk materials and for transferring the same to other locations and/or containers, rather than for use as hoppers for the more or less long term storage of materials. Moreover, none of these reference buckets are adapted for stand alone, stationary mounting and storage of materials, separate and apart from its three point hitch mechanism. Also, none of these assemblies is tiltably operable, separate and apart from its tractor hitch mechanism. Finally, none of these reference bucket assemblies is tiltably seated on a ground mountable frame bed.

As to the assembly disclosed in the Japanese patent, while it includes a bucket which is supported on a vertically movable fork lift frame and is capable of stand alone ground mounting on the frame under certain limited conditions, it is not tiltable relative to the frame to dump materials stored therein. The material storage hopper disclosed in the West German patent is of the stand alone, self supporting type, but is not tiltably supported on a frame of any kind. And while the subject hopper can be lifted, tilted and transported directly by a tractor three point hitch, it does not contain means for self leveling of the hopper when elevated to a given height above the ground by its three point hitch. Neither can the hopper of the West German patent be tilted to dump materials stored therein when in its stationary stand alone condition without the exercise of considerable manual effort, if at all. Lastly, none of the reference hopper assemblies include a ground mountable hopper support frame upon which a hopper is tiltably supported, which frame can be lifted either by a fork lift or by a three point hitch mechanism of a tractor, truck or other vehicle.

By means of my invention, these and other difficulties encountered using three point hitch liftable, tiltable hopper assemblies of the prior art are substantially overcome.

SUMMARY OF THE INVENTION

It is one object of my invention to provide a tiltable hopper assembly which is ground mountable and which can be lifted and transported by either a fork lift or a vehicle, such as a farm or garden tractor, using a vertically movable three point hitch.

It is another object of my invention to provide a tiltable hopper assembly which is self adjusting when lifted and lowered by a three point hitch mechanism so that its hopper support frame remains relatively level within a selected range of elevations above its ground support surface which are within the lifting range of the mechanism and which is self adjusting when returned by such a mechanism from an elevated position to a ground supporting position.

It is also an object of my invention to provide an improved hopper support frame for use with a tiltable hopper assembly.

Briefly, in accordance with my invention, I provide a tiltable hopper assembly which includes a hopper support frame adapted for ground mounting and for releasable attachment to a vertically movable three point hitch mechanism of a vehicle such as a tractor. A material storage hopper supported on the frame and being tiltable between an upright material storing position and a material dumping position is also included. The assembly further includes means for releasably attaching the support frame to the hitch mechanism for permitting the support frame to assume a selected vertical tilt angle relative to horizontal which is between zero degrees and a preselected vertical angle, inclusive, when the support frame is located at a selected height above its ground mounted position within the lifting range of the mechanism. Such means also permits the support frame to fully seat when returned by the mechanism from an elevated position to a ground mounted position. A latch means is also included which is attached to the support frame for releasably securing the hopper in the material storing position.

These and other objects, features and advantages of my invention will become apparent to those skilled in the art from the following detailed description and attached drawings upon which, by way of example, only a preferred embodiment of my invention is described and illustrated.

BRIEF DESCRIPTION OF THE DRAWINGS

FIG. 1 shows a perspective view of a tiltable hopper assembly attached to a vertically movable three point hitch of a farm tractor and disposed in an elevated position, thus illustrating one preferred embodiment of my invention.

FIG. 2 shows a perspective view of a portion of the assembly and tractor hitch of FIG. 1, thus illustrating one of the connections between them.

FIG. 3 shows a side elevation view of the hopper assembly of FIG. 1 with certain parts tom away for viewing clarity.

DESCRIPTION OF THE PREFERRED EMBODIMENT

Figure 4:
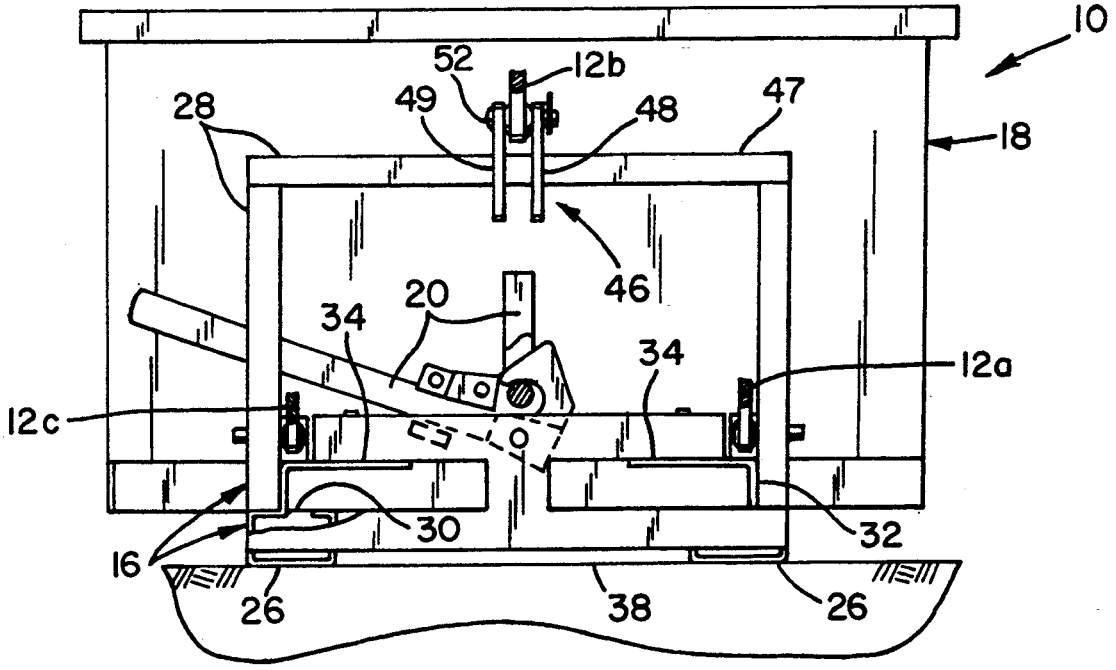
FIG. 4 shows a front elevation view of the hopper assembly of FIGS. 1 and 3 disposed in a lowered, ground mounted position.

Referring now to the drawing figures there is shown, in a single preferred embodiment of my invention, a tiltable hopper assembly, generally designated 10. The assembly 10 can be stationarily mounted as, for example, on the ground at 11 (See FIG. 4). It can also be lifted, lowered and transported by means of a conventional fork lift vehicle, not shown, or a vertically movable three point hitch mechanism 12*a, b, c* as is conventionally employed on various types of vehicles such as, for example, a farm or garden tractor 14.

The assembly 10 includes a hopper support frame 16 and a material storage hopper 18 which is supported on the frame 16 and which is tillable, relative to the frame, between an upright material storing position as shown in full at 18, and a material dumping position as shown in phantom in FIG. 3 at 18'. Also included is a latch 20 of any suitable type which is attached to the frame 16 for releasably securing the hopper 18 in its material storing position. In the present example, the center of gravity of the hopper 18 is such that it tends to tilt toward its material dumping position 18' when the latch 20 is opened or released. Thus, the hopper 18 is gravitationally biased toward its dumping position 18' such that it must be manually tilted from that position to its upright material storing position and secured in the latter position by the latch 20.

Figure 5:
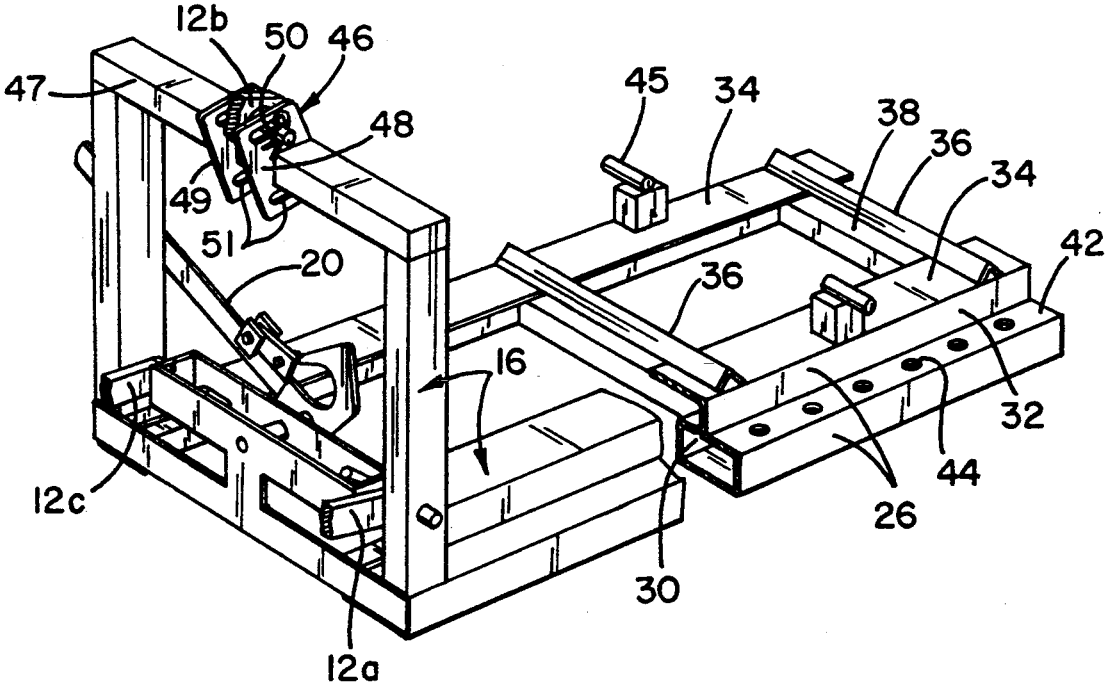
FIG. 5 shows a perspective view of a hopper support frame, which is a portion of the assembly of FIGS. 1 and 3–4 remaining after its tiltable hopper is removed.
Figure 6:
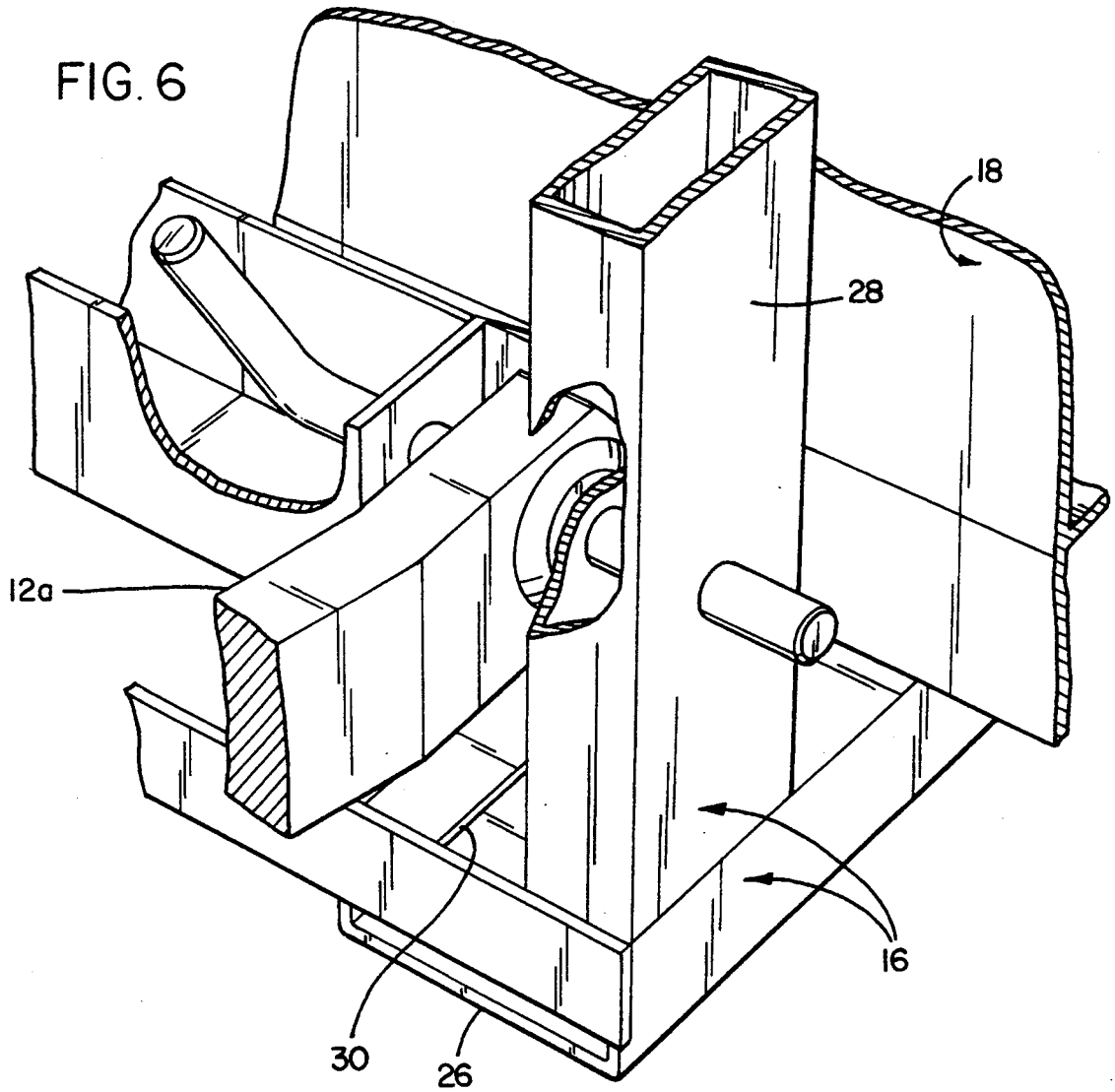
FIG. 6 shows a perspective view of a fragment of the assembly and tractor hitch of FIGS. 1 and 3–4, thus illustrating another connection between them.
Figure 7:
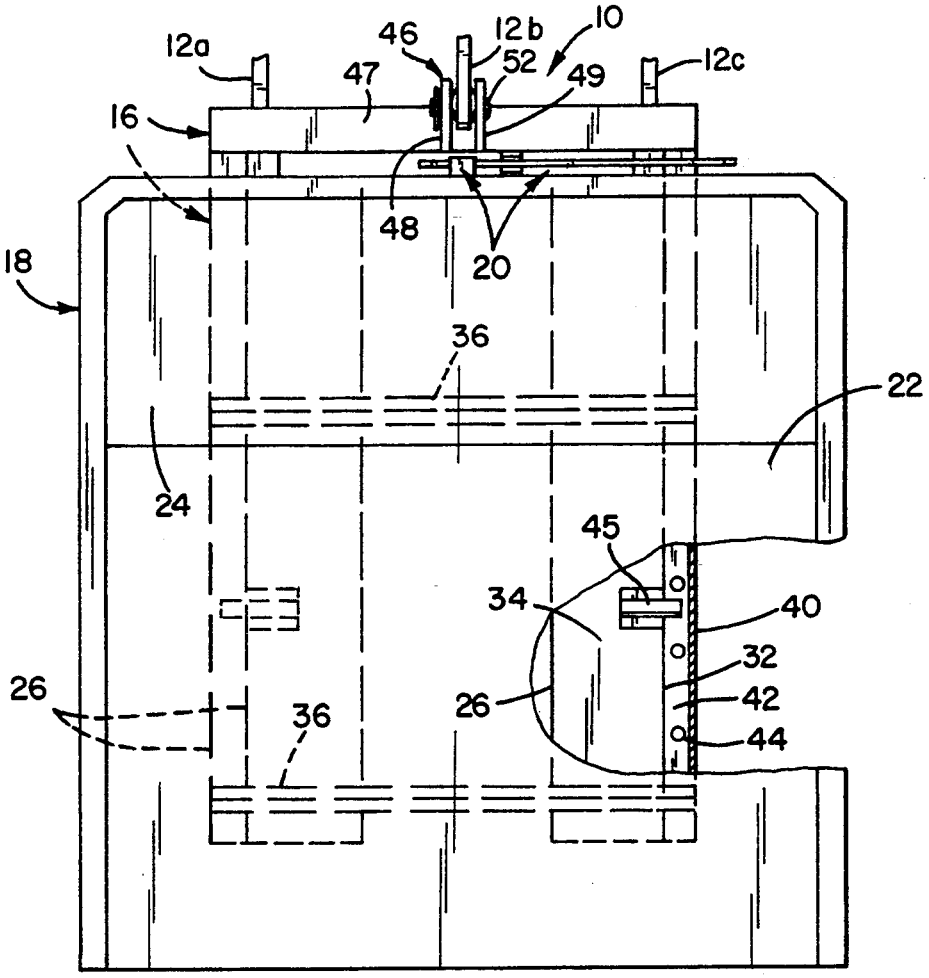
FIG. 7 shows a plan view of the hopper assembly of FIGS. 1 and 3–4 with a portion tom away for viewing clarity.
Figure 8:
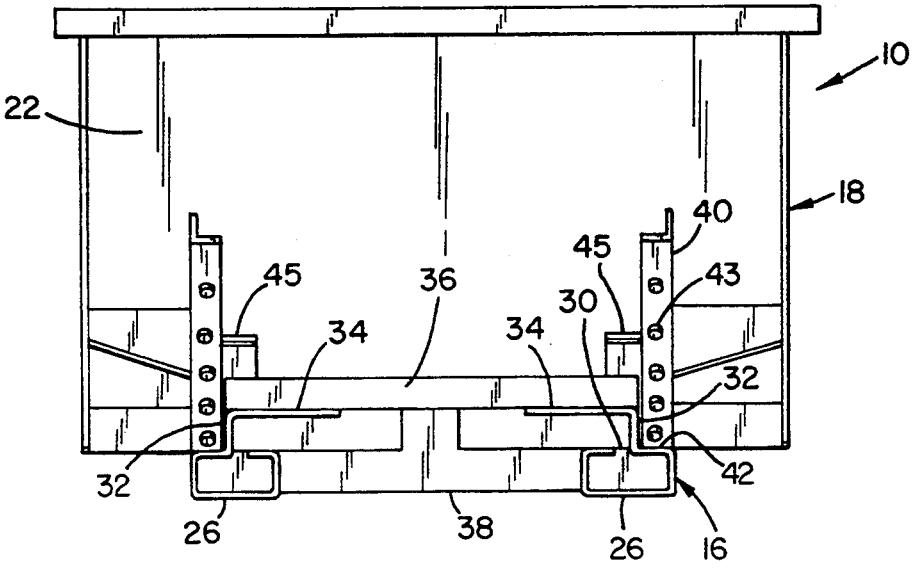
FIG. 8 shows a rear elevation view of the hopper assembly of FIGS. 1, 3–4 and 7.

Relative to its upright position, the hopper 18 contains a diagonally rearwardly extending wall 22, as viewed most clearly in FIGS. 1 and 3, which adjoins a flat base 24 located on a front end portion thereof. The hopper support frame 16 comprises a hopper support bed, which, in the present example, includes a pair of elongated, spaced apart rails 26 upon which the hopper 18 is tiltably disposed, and an inverted U-shaped section 28 which is attached to a front end portion of the rails 26 and extends perpendicularly upward therefrom. As best seen in FIGS. 4–5, each of the rails 26 may be formed from a strip of sheet steel by successively bending the same to form an elongated hollow steel beam of generally rectangular cross-section having a seam 30 which extends along an upper central surface portion of the beam. An excess edge portion of the sheet left over following formation of the beam is successively bent to form a vertical guide wall 32 which extends along an outer edge of the seam 30, and a flange 34 which projects inwardly of its corresponding rail 26 (as viewed in FIG. 8). The flanges 34 thus extend along the upper edges of the guide walls 32 to form supporting surfaces below the hopper 18 under and along which the tines of a fork lift can be placed from the front end of the assembly 10 as viewed in FIG. 4 to lift and transport the entire assembly 10 as an alternative to use of the tractor hitch 12*a, b* and *c*. A pair of elongated, spaced apart angle bars 36 extend between the flanges 34 and are welded to upper surfaces thereof to prevent the flanges 34 from tilting relative to one another when a load is applied to the support bed by the hopper 18 and contents thereof. A pair of spaced apart, spacer beams 38 are disposed between and welded to the beams of the rail 26 so as to maintain a fixed spacing between them.

The hopper 18 contains two spaced apart rounded rocker sections 40 which are welded to the diagonal wall 22 and which roll along upper surfaces 42 of the rail beams as the hopper 18 is tilted on the frame 16. Note that the surfaces 42 are located laterally outward of the guide walls 32 on each of the rails 26 and that the rocker sections 40 roll closely beside these walls. The rocker sections 40 contain a series of cleats 43 which project from the periphery thereof. A like series of holes 44 are located in a row along a rear end portion of each of the surfaces 42 and are spaced apart so as to successively receive the cleats 43 as the rocker sections 40 roll thereover during hopper dumping operations. The cleats 43 and holes 44 should be arranged so that at least two successive ones of the cleats 43 project, at least partially, into corresponding ones of the holes 44 under all dispositions of the hopper 18 relative to the rails 26 so as to maintain proper alignment of the rocker sections 40 on the surfaces 42. The guide walls 32, being located immediately inwardly of their respective adjacent rocker sections 40, also aid in maintaining such alignment. The rocker sections 40 are restrained from rolling off the rear end of the rails 26 by a pair of laterally outwardly projecting stop members 45 which are affixed to the flanges 34.

An important feature of my invention is illustrated in the present example by way of a bracket 46 attached to mid portion of a cross member 47 of the U-shaped section 28. The bracket 46 of this example is constructed of two spaced apart steel plates 48, 49 which define a first pair of arc shaped slots 50 which register with one another and which are located above the cross member 47, and a second pair of similarly shaped and aligned arc shaped slots 51 which are located below the cross member. The third or central member 12*b* of the conventional three point tractor hitch inserts between the plates 48, 49 and contains a pin 52, 52' which extends to either side of the central member into either the lower aligned pair of slots 51, or, as in the present example, the upper aligned pair of slots 50. The pin 52 is free to move from one end to the other of such aligned slots 50 or 51 as the hitch 12*a, b, c* raises and lowers the frame 16.

With the assembly 10 ground mounted as in FIG. 4, the three point hitch arms 12*a, b, c* are attached to the frame section 28 with the pin 52 of the third member 12*b* being connected in the aligned slots 50 of the bracket 46 as shown. Thereafter, the hitch mechanism 12*a, b, c* is activated by the tractor 14 to lift the entire assembly 10 to an elevated position within its lifting range. As this lifting action occurs, the third hitch member 12*b* tilts upwardly through a vertical arc. As this occurs, the aligned slots 50 allow the pin 52 to move from a rear end of the slots 50, as at 52' in FIG. 2, when the assembly 10 is at ground level, to a forward end of the slots 50 when elevated. See this latter mentioned condition of the pin 52 in the slots 50 when the assembly 10 is elevated as shown in full in FIGS. 1–3. Thus the slots 50 permit the pin 52 and attached third member 12*b* to move relative to the bracket as the member 12*b* tilts, while lifting and lowering the assembly 10, so as to keep the assembly 10 approximately level when at a desired height above the ground. The slots 50 also permit the frame rails 26 to seat fully upon level ground when returned to that position from an elevated height, since the effect of tilting of the third member 12*b* without such slots would otherwise be to tilt the frame 16 as it is lifted and lowered.

The slots 50 located above the cross member 47 are intended for use with the relative long third member of a three point hitch employed on a relatively large farm tractor. The aligned arc shaped slots 51 in the bracket plates 48, 49 located below the cross member 47 are intended for use with the relatively shorter third member of a three point hitch employed on a relatively smaller garden type tractor.

Although the present invention has been described with respect to specific details of a certain preferred embodiment thereof it is not intended that such details limit the scope of this patent other than as specifically set forth in the following claims.

I claim:

1. A tiltable hopper assembly comprising a hopper support frame adapted for ground mounting and for releasable attachment to a vertically movable three point hitch mechanism of a vehicle, including a tractor, said support frame comprising a hopper support bed including a pair of elongated, spaced apart, parallel extending rails, and spacer means connected between said rails for maintaining a fixed spacing between said rails, each of said rails comprising a hollow beam of essentially rectangular cross-section having a seam extending lengthwise along an upper central surface portion thereof, an elongated guide wall attached to an upper surface of said beam and extending normally upward relative thereto, said guide wall being located along an outer edge of said beam, and a flange attached to an upper edge portion of said guide wall and projecting inwardly of said bed, said flange being spaced above an upper surface of said beam such that a fork lift tine can be inserted between said beam and flange from a front end of said assembly to permit the lifting and transport thereof by a fork lift, said support frame further comprising a frame section attached to and extending perpendicularly upward from an end portion of said bed, said hitch mechanism being releasably attachable to said section, said hopper assembly further comprising a material storage hopper, said hopper being tiltably disposed on said rails so as to be supported on said frame and being tiltable on said rails between an upright material storing position and a material dumping position, means for releasably attaching said support frame to said hitch mechanism for permitting said support frame to assume a selected vertical tilt angle relative to horizontal which is between zero degrees and a preselected maximum vertical tilt angle, inclusive, when said support frame is located at a selected height above its ground mounted position within the lifting range of said mechanism and for permitting said support frame to fully seat when returned by said mechanism from an elevated position to a ground mounted position, and latch means attached to said support frame for releasably securing said hopper in said material storing position.

2. The hopper assembly of claim 1 wherein said hopper is gravitationally biased toward said dumping position, said hopper being manually tiltable from said dumping position to said upright material storing position.

3. The hopper assembly of claim 1 further comprising means attached to said support frame for permitting the tines of a fork lift to be inserted thereunder to lift said support frame and hopper as an alternative to the use of a three point hitch mechanism.

4. The hopper assembly of claim 1 wherein said attaching means comprises a bracket fixedly attached to said frame section, said bracket defining at least one pair of elongated, spaced apart, arc shaped slots which are disposed in registry with one another and which are adapted to capture a pin attached to a central member of said three point hitch mechanism therein, said pin being freely slidable between opposite ends of said pair of slots as said three point hitch mechanism is lifted and lowered to lift and lower said support frame and hopper.

5. The hopper assembly of claim 4 wherein said bracket comprises a pair of spaced apart plates having broad surfaces lying parallel and in registry with one another, said plates defining first and second vertically spaced apart pairs of said slots.

6. The hopper assembly of claim 1 wherein said hopper includes a pair of spaced apart, rounded rocker sections for enabling said hopper to tilt on said rails between said positions, said sections being rollable along an upper surface portion of said beams outwardly and alongside of said guide walls.

7. The hopper assembly of claim 6 wherein each of said rocker sections include a series of radially outwardly projecting, spaced apart cleats attached to a periphery thereof, said upper surface portion of a said beams along which each of said rocker sections roll defining a series of spaced apart openings for successively receiving the cleats of a corresponding one of said rocker sections as said rocker sections roll along said beams to tilt said hopper to said dumping position.

8. The hopper assembly of claim 6 further comprising a pair of stop members attached to said flanges, said stop members including pins which project transversely outwardly relative to said rails which engage said rocker sections to restrain said hopper from tilting off of a rear end of said rails when tilted to said material dumping position.

9. A tiltable hopper assembly comprising a hopper support frame adapted for direct ground mounting and for releasable attachment to a vertically movable three point hitch mechanism of a vehicle, including a track, such that said frame can be lifted and lowered between a direct ground mounted position and any level above said direct ground mounted position which is within the lifting range of said mechanism, said support frame including a hopper support bed, including a pair of elongated, spaced apart, parallel extending rails, and spacer means connected between said rails for maintaining a fixed spacing between said rails, said support frame further including a frame section attached to and extending perpendicularly upward from an end portion of said bed, said hitch mechanism being releasably attachable to said section, each of said rails comprising a hollow beam of essentially rectangular cross-section having a seam extending lengthwise along an upper central surface portion thereof, an elongated guide wall attached to an upper surface portion of said beam and extending normally upward relative thereto, said guide wall being located along an outer edge of said seam, a flange attached to an upper edge portion of said guide wall and projecting inwardly of said bed, said flange being spaced above an upper surface of said beam such that a fork lift tine can be inserted between said beam and flange from a front end of said assembly to permit the lifting and transport of said rails by a fork lift, a material storage hopper tiltably disposed on said rails so as to be supported on an upwardly facing surface portion of said frame and being tiltable on said surface portion between an upright material storing position and a material dumping position, means for releasably attaching said support frame to said hitch mechanism with said hopper being supported on said surface portion for permitting said support frame to assume a selected vertical tilt angle relative to horizontal which is between zero degrees and a preselected maximum vertical tilt angle, inclusive, when said support frame, with said hopper supported thereon, is located at a selected height above said direct ground mounted position within the lifting range of said mechanism and for permitting said support frame with said hopper supported thereon to fully seat when returned by said mechanism from an elevated position to said direct ground mounted position, and latch means attached to said support frame for releasably securing said hopper on said surface portion in said material storing position.

10. A tiltable hopper assembly comprising a hopper support frame adapted for ground mounting and for releasable attachment to a vertically movable three point hitch mechanism of a vehicle, including a tractor, a material storage hopper supported on said frame and being tiltable thereon between an upright material storing position and a material dumping position, said hopper including a pair of spaced apart, rounded rocker sections for enabling said hopper to tilt on said frame between said positions, said sections being rollable along an upwardly facing surface portion of said frame during the entire tilting movement of said hopper between said upright and dumping positions, means for releasably attaching said support frame to said hitch mechanism for permitting said support frame to assume a selected vertical tilt angle relative to horizontal which is between zero degrees and a preselected maximum vertical tilt angle, inclusive, when said support frame is located at a selected height above its ground mounted position within the lifting range of said mechanism and for permitting said support frame to fully seat when returned by said mechanism from an elevated position to a ground mounted position, and latch means attached to said support frame for releasably securing said hopper in said material storing position.

11. The hopper assembly of claim 10 wherein each of said rocker sections include a series of radially outwardly projecting, spaced apart cleats attached to a periphery thereof, said upper surface portion of said frame along which each of said rocker sections roll defining a series of spaced apart openings for successively receiving the cleats of a corresponding one of said rocker sections as said rocker sections roll along said frame to tilt said hopper to said dumping position.

12. The hopper assembly of claim 10 further comprising a pair of stop members attached to said flanges, said stop members including pins which project transversely outwardly relative to said rails which engage said rocker sections to restrain said hopper from tilting off of a rear end of said rails when tilted to said material dumping position.

13. The hopper assembly of claim 10 further comprising means attached to said support frame for permitting the tines of a fork lift to be inserted thereunder to lift said support frame and hopper as an alternative to the use of a three point hitch mechanism.

* * * * *

UNITED STATES PATENT AND TRADEMARK OFFICE

CERTIFICATE OF CORRECTION

PATENT NO. : 5,364,224

DATED : : November 15, 1994

INVENTOR(S) : James R. Padgett

It is certified that error appears in the above-indentified patent and that said Letters Patent is hereby corrected as shown below:

Column 6, line 56, "track" should read --tractor--.

Signed and Sealed this

Twenty-first Day of February, 1995

*Attest:*

Bruce Lehman

BRUCE LEHMAN

*Attesting Officer*

*Commissioner of Patents and Trademarks*